US008462183B2

(12) United States Patent
Nagai

(10) Patent No.: US 8,462,183 B2
(45) Date of Patent: Jun. 11, 2013

(54) ELECTRONIC APPARATUS AND IMAGE FORMING APPARATUS

(75) Inventor: Hitoshi Nagai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 864 days.

(21) Appl. No.: 12/073,397

(22) Filed: Mar. 5, 2008

(65) Prior Publication Data

US 2008/0226347 A1 Sep. 18, 2008

(30) Foreign Application Priority Data

Mar. 15, 2007 (JP) ..... 2007-066967

(51) Int. Cl.
*B41J 2/41* (2006.01)
*B41J 2/435* (2006.01)
*B41J 2/385* (2006.01)

(52) U.S. Cl.
USPC ..... 347/152; 347/228; 347/140

(58) Field of Classification Search
USPC ..... 347/152, 170, 222, 257, 263, 228, 347/140
See application file for complete search history.

(56) References Cited

U.S. PATENT DOCUMENTS

| | | | | |
|---|---|---|---|---|
| 5,177,500 | A * | 1/1993 | Ng | 347/245 |
| 5,660,486 | A * | 8/1997 | Okuda et al. | 400/120.07 |
| 5,714,995 | A * | 2/1998 | Wiklof et al. | 347/208 |
| 6,439,678 | B1 * | 8/2002 | Norton | 347/9 |
| 2002/0130912 | A1 * | 9/2002 | Beck et al. | 347/12 |
| 2004/0017460 | A1 * | 1/2004 | Kagami et al. | 347/104 |
| 2005/0128282 | A1 * | 6/2005 | Yamagata | 347/230 |

FOREIGN PATENT DOCUMENTS

JP 2000-181165 6/2000

* cited by examiner

*Primary Examiner* — Stephen Meier
*Assistant Examiner* — Sarah Al Hashimi
(74) *Attorney, Agent, or Firm* — Kubotera & Associates, LLC.

(57) ABSTRACT

An electronic apparatus includes a main body; a maintenance member operated by an operator for maintenance; and a hand touch member disposed on the maintenance member. The hand touch member is formed of a conductive material, and is connected to a ground portion disposed in the main body.

13 Claims, 6 Drawing Sheets

ELECTRONIC APPARATUS AND IMAGE FORMING APPARATUS

BACKGROUND OF THE INVENTION AND RELATED ART STATEMENT

The present invention relates to an electronic apparatus and an image forming apparatus.

In a conventional image forming apparatus such as an electronic apparatus of a printer, a copier, a facsimile, a multi-function product, and the likes, an LED (Light Emitting Diode) head is disposed. A supporting holder supports the LED head, and a coil spring regulates an operational position of the LED head.

When the conventional image forming apparatus is turned on, static electricity is generated inside the conventional image forming apparatus. To this end, it is arranged such that static electricity accumulated in the LED head and the likes is conducted to the supporting holder through the coil spring. Further, static electricity is released to a ground portion through a circuit portion in the conventional image forming apparatus (refer to Patent Reference).

Patent Reference: Japanese Patent Publication No. 3504170

In the conventional image forming apparatus, when an operator touches a rod lens array disposed on a surface of the LED head, static electricity accumulated in the operator may be conducted to an LED array of the LED head and a circuit board with a drive IC (Integrated Circuit) mounted thereon through the rod lens array, thereby damaging the circuit board.

In the view of the problems described above, an object of the present invention is to provide an electronic apparatus and an image forming apparatus capable of solving the problems of the conventional image forming apparatus. In the electronic apparatus and the image forming apparatus of the present invention, it is possible to prevent a circuit board from being damaged due to static electricity.

Further objects and advantages of the invention will be apparent from the following description of the invention.

SUMMARY OF THE INVENTION

In order to attain the objects described above, according to a first aspect of the present invention, an electronic apparatus includes a main body; a maintenance member operated by an operator for maintenance; and a hand touch member disposed on the maintenance member. The hand touch member is formed of a conductive material, and is connected to a ground portion disposed in the main body.

According to a second aspect of the present invention, an electronic apparatus includes a main body; and an operation member for providing an access to the main body. The operation member is formed of a conductive material, and is connected to a ground portion disposed in the main body.

According to a third aspect of the present invention, an image forming apparatus includes a main body; a maintenance member operated by an operator for maintenance; and a hand touch member disposed adjacent to the maintenance member. The hand touch member is formed of a conductive material, and is connected to a ground portion disposed in the main body.

In the present invention, the electronic apparatus includes the main body; the maintenance member operated by the operator for maintenance; and the hand touch member disposed on the maintenance member. The hand touch member is formed of the conductive material, and is connected to the ground portion disposed in the main body.

In particular, the hand touch member is disposed on the maintenance member, and the hand touch member is connected to the ground portion. Accordingly, static electricity accumulated in the operator is released to the ground portion through the hand touch member, and is not conducted to a circuit board. As a result, it is possible to prevent the circuit board from being damaged.

DETAILED DESCRIPTION OF THE PREFERRED EMBODIMENTS

Hereunder, embodiments of the present invention will be explained with reference to the accompanying drawings.

First Embodiment

Figure 1:
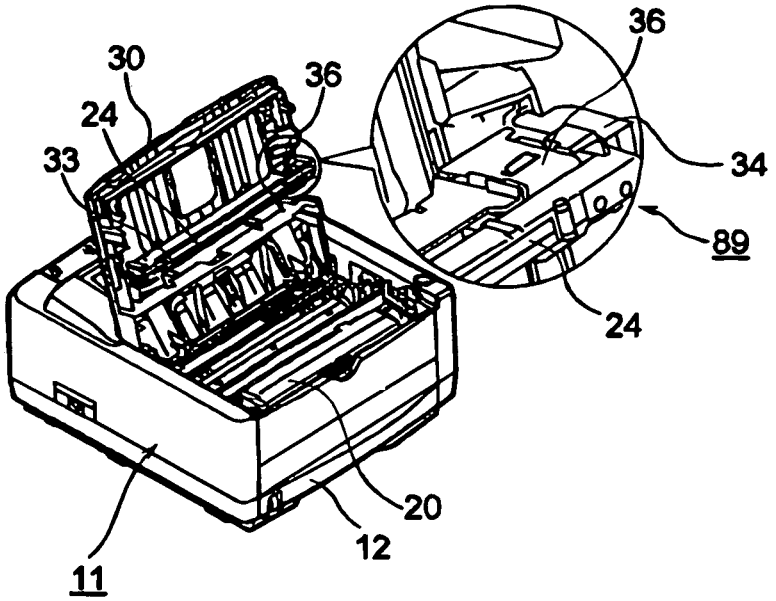
FIG. 1 is a perspective view showing a printer according to a first embodiment of the present invention.
Figure 2:
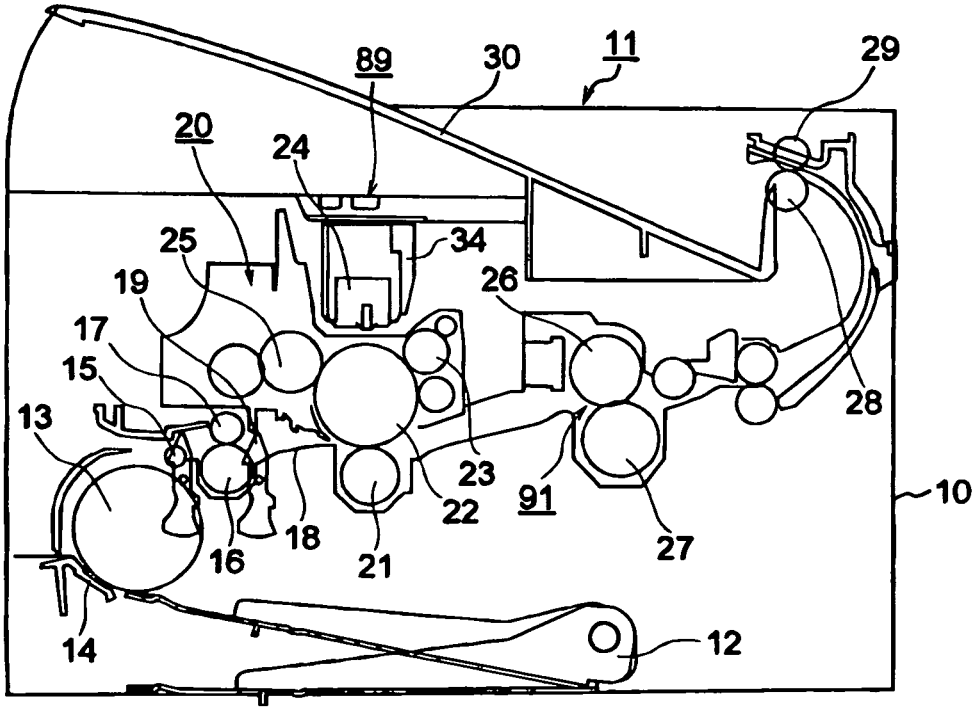
FIG. 2 is a schematic sectional view showing the printer according to the first embodiment of the present invention.

A first embodiment of the present invention will be explained. FIG. 1 is a perspective view showing a printer 11 according to the first embodiment of the present invention. FIG. 2 is a schematic sectional view showing the printer 11 according to the first embodiment of the present invention.

As shown in FIG. 1, the printer 11 includes a medium cassette 12 as a medium storage unit for storing a sheet (not shown) as a medium. After a sheet supply roller 12 and a separation member 14 separate and pick up the sheet one by one, the sheet reaches a sucking sensor 15 as a first medium detection unit. After the sucking sensor 15 detects the sheet, a resister roller 16 and a pinch roller 17 transport the sheet to a transportation path 18.

When a passing sensor 19 as a second medium detection unit detects the sheet, an image forming unit 20 constituting an image forming device forms a toner image as a developer image. Then, a transfer roller 21 as a transfer device transfers the toner image to the sheet.

A configuration of the image forming unit 20 will be explained next. In the image forming unit 20, a charging roller 23 as a charging device uniformly charges with negative polarity a surface of a photosensitive drum 22 as an image supporting member disposed to be freely rotatable. When a portion of the photosensitive drum 22 charged with negative polarity reaches a position facing an exposure unit 89 as an exposure device, the exposure unit 89 exposes the photosensitive drum 22. Accordingly, a static latent image as a latent image is formed on the surface of the photosensitive drum 22 thus charged according to image data.

In the embodiment, a developer roller 25 as a developer supporting member develops the static latent image to form the toner image. Then, the transfer roller 21 transfers the toner image to the sheet.

After the transfer roller 21 transfers the toner image to the sheet, the sheet is transported to a fixing unit 91 as a fixing device. The fixing unit 91 includes a heating roller 26 as a heating member, and a pressing roller 27 as a pressing member arranged to contact with the heating roller 26. The heating roller 26 and the pressing roller 27 sandwich and transport the sheet with the toner image transferred thereon for heating and pressing the sheet, so that the toner image is fixed to the sheet.

After the toner image is fixed to the sheet, a discharge roller 28 and a follower roller 29 discharge the sheet to a discharge stacker 30. The discharge stacker 30 includes a cover of the printer 11, and is disposed to be rotatable around a shaft (not shown) with respect to a main body of the printer 11 or a lower housing 10 of the main body.

In the embodiment, the exposure unit 89 includes an LED (Light Emitting Diode) head 24 as an exposure member, and a supporting holder 34 as a holding member disposed on a backside of the discharge stacker 30 for holding the LED head 24. A conductive film 36 as a hand touch member or a discharging member is disposed on the supporting holder 34. Further, a rod lens array 33 as a light collecting member is disposed on the LED head 24.

A configuration of the exposure unit 89 will be explained next with reference to FIGS. 3 to 6.

Figure 3:
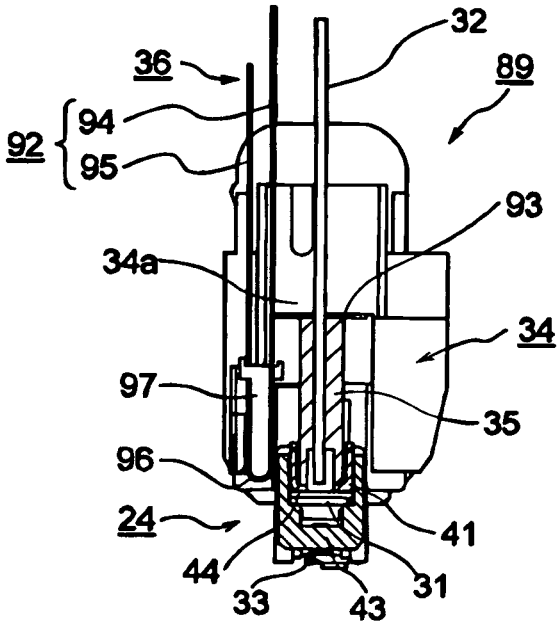
FIG. 3 is a sectional view showing an exposure device unit according to the first embodiment of the present invention.
Figure 4:
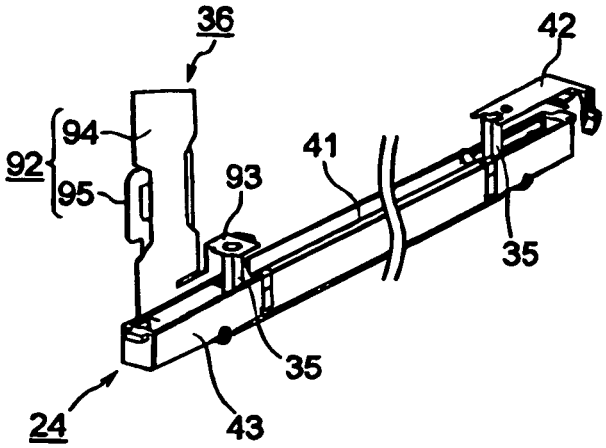
FIG. 4 is a perspective view showing an LED (Light Emitting Diode) head according to the first embodiment of the present invention.
Figure 5:
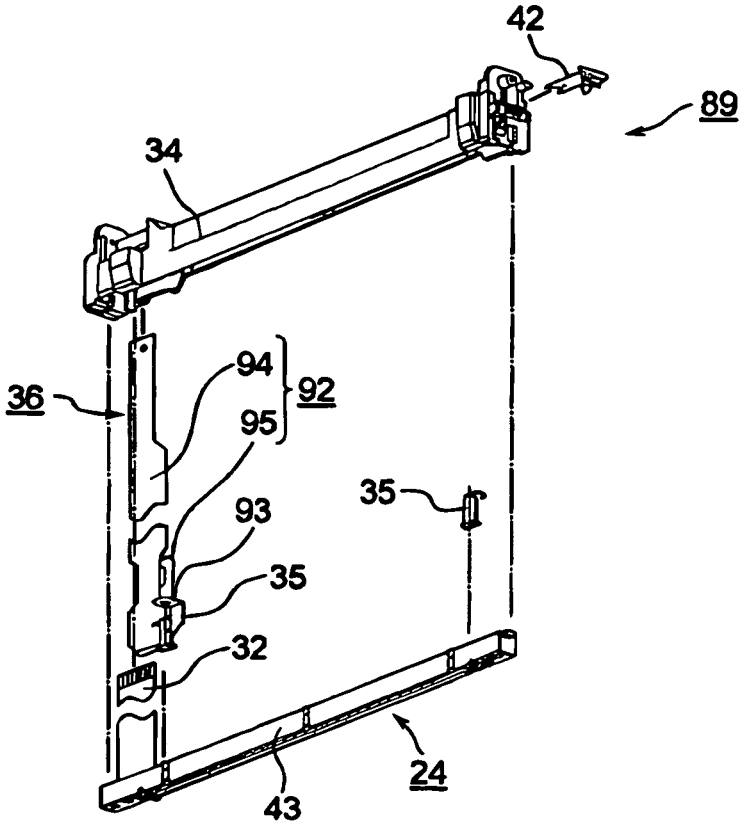
FIG. 5 is an exploded perspective view of the exposure device unit according to the first embodiment of the present invention.
Figure 6:
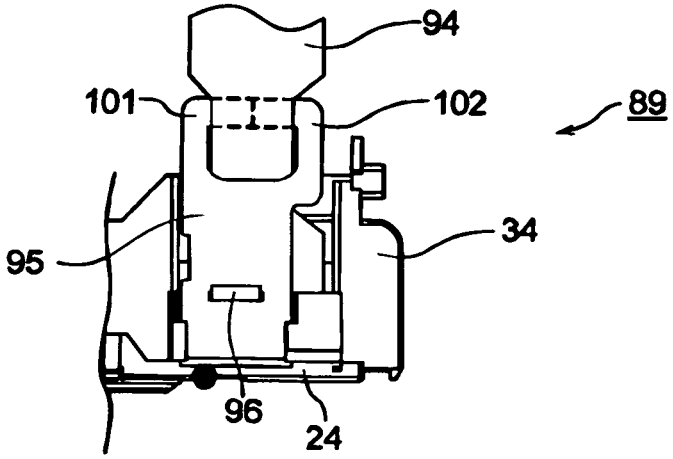
FIG. 6 is a side view of the exposure device unit according to the first embodiment of the present invention.

FIG. 3 is a sectional view showing the exposure device unit 89 according to the first embodiment of the present invention. FIG. 4 is a perspective view showing an LED (Light Emitting Diode) head 24 according to the first embodiment of the present invention. FIG. 5 is an exploded perspective view of the exposure device unit 89 according to the first embodiment of the present invention. FIG. 6 is a side view of the exposure device unit 89 according to the first embodiment of the present invention.

As shown in FIG. 3, the exposure unit 89 includes the LED head 24 and the supporting holder 34. The LED head 24 includes an LED array 31 formed of a plurality of LEDs as light emitting elements for emitting light to form the static latent image. The LED array 31 is disposed on a circuit board (not shown) or a first control unit together with a drive IC as a drive unit, so that the drive IC drives the LED array 31.

In the embodiment, the circuit board is connected to a control circuit board (not shown) or a second control unit disposed on a side of the apparatus main body through a connection cable 32. A CPU (Central Processing Unit) as a control device, a memory as a storage device, and the likes are mounted on the control circuit board for controlling a whole operation of the printer 11 (FIG. 2).

When the CPU sends an image signal to the LED head 24 through the connection cable 32, the LEDs of the LED array 31 selectively emit light-according to the image signal. The rod lens array 33 collects light thus emitted, and irradiates light on the surface of the photosensitive drum 22. Accordingly, the photosensitive drum 22 is exposed, so that the static latent image including an image portion and a non-image portion is formed on the surface of the photosensitive drum 22.

In the embodiment, a board of the LED head 24, the LED array 31, the drive IC, the rod lens array 33, and the likes are formed of a non-conductive material. An LED holder 43 as a light emitting portion holding member holds and supports the LED head 24, the LED array 31, the drive IC, the rod lens array 33, and the likes. The LED holder 43 has a U-character shape section. A print head base 41 as a base member having a U-character shape section covers an upper portion of the LED holder 43, thereby protecting the LED head 24, the LED array 31, the drive IC, the rod lens array 33, and the likes.

In the embodiment, the print head base 41 is formed of a conductive material such as a metal material, and is attached to the LED holder 43 with a non-conductive adhesive such as a silicone adhesive. An insulation sheet 44 formed of a non-conductive material is disposed between the LED array 31 and the print head base 41.

With the configuration described above, the LED holder 43 and the insulation sheet 44 cover the components such as the board of the LED head 24, the LED array 31, the drive IC, the rod lens array 33, and the likes disposed in the LED holder 43. Accordingly, it is possible to protect the components from an external electrical influence.

In the embodiment, a pair (a plurality) of coil springs 35 as an urging member formed of a conductive material such as a metal material is disposed on the print head base 41. Each of the coil springs 35 has one end portion abutting against the print head base 41, and the other end portion abutting against a pressing portion 34a formed on the supporting holder 34. Accordingly, the springs 35 urge the LED head 24 downwardly toward the LED head 24.

In the embodiment, a regulation member (not shown) is disposed on the supporting holder 34 for regulating the LED head 24, so that the LED head 24 does not move vertically beyond a specific distance. Accordingly, the LED head 24 is situated at an appropriate position with respect to the image forming unit 2.

When an operation unit of the printer 11 starts operating, static electricity generated inside the printer 11, for example, the image forming unit 2 contacting with the LED head 24, is charged in the print head base 41 and the likes. To this end, the exposure unit 89 is provided with a contact 42 as a contact member, so that static electricity accumulated in the LED head 24 and the likes is conducted to the contact 42. Accordingly, static electricity is released to a ground portion of a power circuit board (not shown) through a circuit portion inside the printer 11 and a conductive member of the main body formed of a conductive material such as a metal material.

As described above, the conductive film 36 is disposed at a specific position of the supporting holder 34. The conductive film 36 is formed of a conductive material such as aluminum foil. Further, the conductive film 36 includes a main portion 92 having a U-character shape and a contact portion 93 extending from the main portion 92. The main portion 92 has a first band portion 94, a second band portion 95, and a bent portion 96.

In the embodiment, a pressing member 97 is provided for pressing the bent portion 96, so that the conductive film 36 is attached to the supporting holder 34. The second band portion 95 has arm portions 101 and 102 at a distal end thereof. The arm portions 101 and 102 engage with each other at a backside of the first band portion 94, so that the first band portion 94 and the second band portion 95 surround the pressing member 97. Accordingly, it is possible to stably attach the conductive film 36 to the supporting holder 34.

In the embodiment, the first band portion 94 passes through the supporting holder 34, and extends upwardly. A distal end of the first band portion 94 is attached to the discharge stacker 30, so that the first band portion 94 is electrically connected to the conductive member connected to the ground portion of the main body through the discharge stacker 30. Accordingly, the first band portion 94 is electrically connected to the conductive member of the main body from the supporting holder 34.

Further, the contact portion 93 is electrically connected to an upper end of the coil spring 35. Accordingly, it is possible to conduct static electricity accumulated or charged in the LED head 24 to the conductive film 36 through the coil spring 35, and to release static electricity to the ground portion of the power circuit board through the conductive member of the main body and the likes.

Further, it is possible to release static electricity received with the conductive film 36 to the ground portion of the power circuit board through the first band portion 94 and the conductive member of the main body. Still further, it is possible to release static electricity from the contact portion 93 to the ground portion of the power circuit board through one of the coil springs 35, the print head base 41, the other of the coil springs 35, the contact 42, the circuit portion inside the printer 11, the conductive member of the main body, and the likes.

As described above, in the embodiment, it is possible to prevent static electricity generated in the LED head 24 and the likes or static electricity received with the conductive film 36 from conducting to the circuit board of the LED head 24, thereby preventing the circuit board from being damaged.

When the printer 11 prints on the sheets, as the number of the sheets increases, toner as developer, paper powder, and the likes may adhere to the rod lens array 33, thereby lowering image quality. To this end, the rod lens array 33 is regularly cleaned. In particular, when a specific number of sheets are printed, the rod lens array 33 is cleaned with, for example, a soft cloth, thereby cleaning the rod lens array 33. In this case, the LED head 24, the rod lens array 33, and the likes constitute a maintenance member.

As described above, in the embodiment, the conductive film 36 is disposed near the rod lens array 33. Accordingly, an operator can touch the conductive film 36 disposed on the supporting holder 34 before touching the rod lens array 33, so that static electricity accumulated in the operation can be released to the ground portion through the conductive film 36.

As described above, in the embodiment, the conductive film 36 connected to the ground portion is disposed near the component requiring a maintenance operation such as cleaning. Accordingly, when the operator performs such a maintenance operation, the operator can release static electricity accumulated therein to the ground portion. As a result, static electricity accumulated in the operator is not conducted to the circuit board of the LED head 24, thereby preventing the circuit board from being damaged.

Note that the present invention is applicable to a case, in which a maintenance operation is performed for replacing the image forming unit 2 and the likes as a consumable supply detachably attached to the main body.

In this case, the image forming unit 2 constitutes the maintenance member. A metal member as a discharging member and a hand touch member formed of a conductive material is attached to a handle of the image forming unit 2. The metal member is electrically connected to the ground portion of the power circuit board. Accordingly, when the operator touches the handle to replace the image forming unit 2, it is possible to release static electricity accumulated in the operator to the ground portion through the metal member.

When the image forming unit 2 is formed of a main body of the image forming unit 2, i.e., an image forming unit main body, and a toner cartridge as a developer storage unit detachably attached to the image forming unit main body, the toner cartridge constitute a consumable supply. In this case, the image forming unit 2 and the toner cartridge constitute a maintenance member.

Second Embodiment

A second embodiment of the invention will be described next. Components in the second embodiment similar to those in the first embodiment are designated by the same reference numerals, and explanations thereof are omitted. Further, explanations of operations and effects in the second embodiment similar to those in the first embodiment are omitted.

Figure 7:
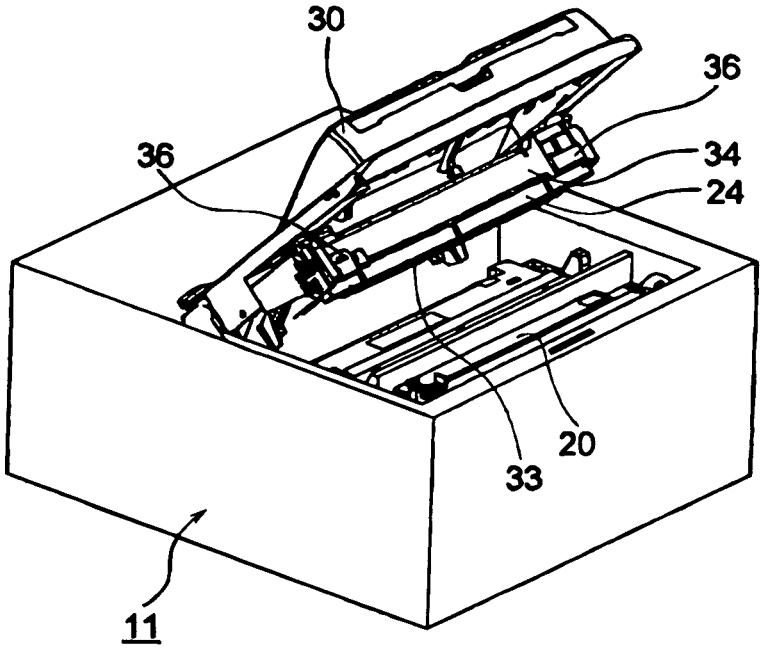
FIG. 7 is a perspective view showing a printer according to a second embodiment of the present invention.
Figure 8:
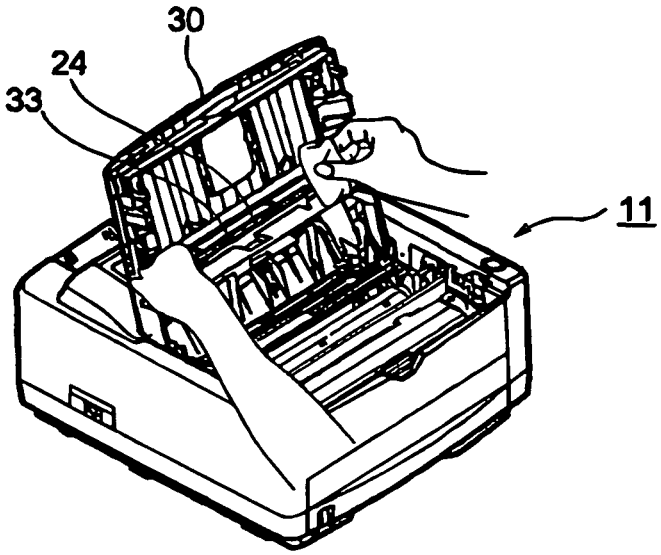
FIG. 8 is a perspective view of the printer in use according to the second embodiment of the present invention.

FIG. 7 is a perspective view showing the printer 11 according to a second embodiment of the present invention. FIG. 8 is a perspective view of the printer 11 in use according to the second embodiment of the present invention.

As shown in FIG. 7, in the embodiment, the conductive films 36 as the hand touch member are disposed on both sides of the LED head 24 as the exposure member.

As shown in FIG. 8, when the rod lens array 33 is cleaned with both hands, for example, a left hand holds the LED head 24 and a right hand wipes the rod lens array 33 as the light collecting member, so that the both hands naturally touch the conductive films 36. Accordingly, it is possible to release static electricity accumulated in the operator to the ground portion through the conductive films 36.

Third Embodiment

A third embodiment of the invention will be described next. Components in the third embodiment similar to those in the first and second embodiments are designated by the same reference numerals, and explanations thereof are omitted. Further, explanations of operations and effects in the third embodiment similar to those in the first and second embodiments are omitted.

Figure 9:
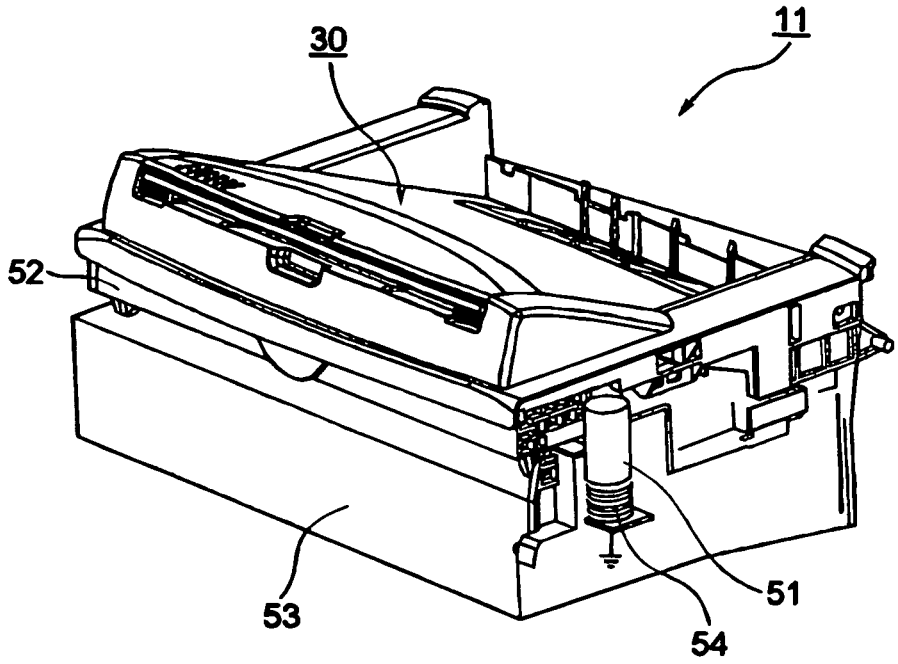
FIG. 9 is a perspective view showing a printer according to a third embodiment of the present invention.
Figure 10:
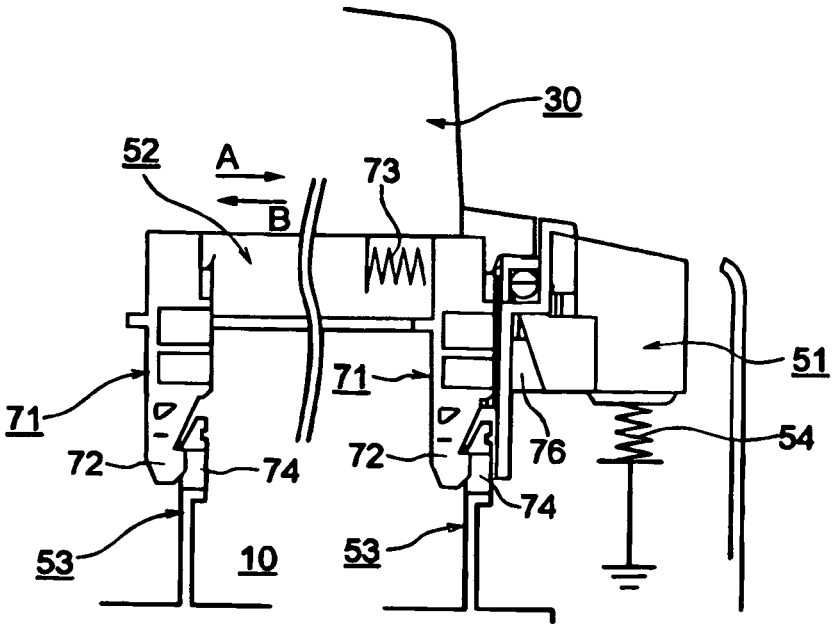
FIG. 10 is a schematic view No. 1 showing a cover of the printer according to the third embodiment of the present invention.
Figure 11:
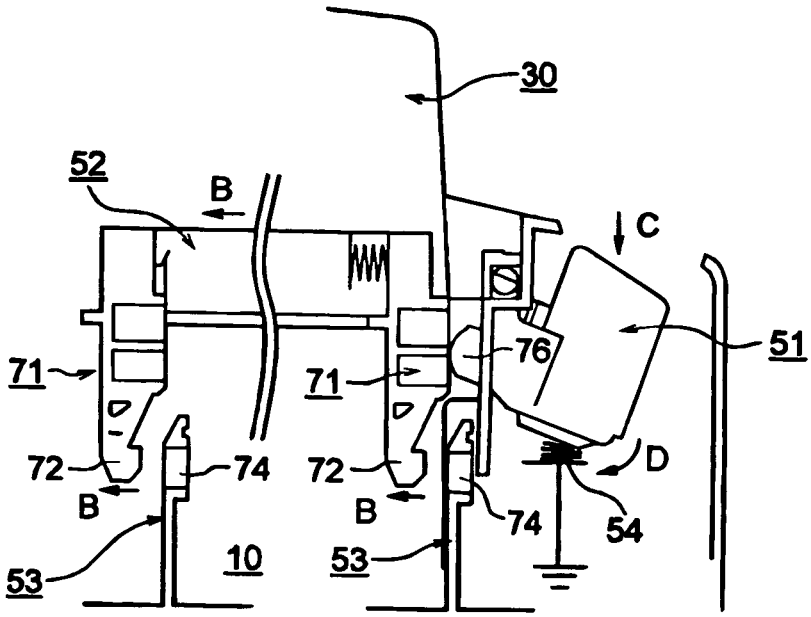
FIG. 11 is a schematic view No. 2 showing the cover of the printer according to the third embodiment of the present invention.

FIG. 9 is a perspective view showing the printer 11 according to the third embodiment of the present invention. FIG. 10 is a schematic view No. 1 showing a cover of the printer according to the third embodiment of the present invention. FIG. 11 is a schematic view No. 2 showing the cover of the printer according to the third embodiment of the present invention.

As shown in FIGS. 9 to 11, the discharge stacker 30 includes an opening/closing lever 52 disposed to be movable in arrow directions A and B. The opening/closing lever 52 has a pair of engagement members 71 extending downwardly. Each of the engagement members 71 has a hook 72 as a first engagement portion at a distal end thereof.

In the embodiment, a spring 73 as an urging member is provided for urging the opening/closing lever 52 in the arrow direction A. In particular, one end portion of the spring 73 abuts against a specific portion of the lower housing 10, and the other end portion of the spring 73 abuts against a specific portion of the opening/closing lever 52.

In the embodiment, the lower housing 10 has a pair of engaged members 53 extending upwardly at positions corresponding to the engagement members 71. Each of the engaged members 53 has a hole 74 as a second engagement portion for engaging the hook 72.

In the embodiment, a cover open switch 51 as an operation member and an opening operation member is disposed to be freely rotatable with respect to the lower housing 10 for opening the discharge stacker 30. A spring 54 as an urging member is disposed under the cover open switch 51. One end portion of the spring 54 abuts against an end portion of the cover open switch 51, and the other end portion of the spring abuts against a specific portion of the lower housing 10. Further, a pressing portion 76 is provided on the cover open switch 51 at a position facing the opening/closing lever 52, so that the pressing portion 76 abuts against the opening/closing lever 52.

In the embodiment, the cover open switch 51 is formed of a conductive material such as polyacetal containing a conductive additive such as a carbon fiber, a metal fiber, a conductive carbon black, and the likes, and the spring 54 is also formed of a conductive material. The other end portion of the spring 54 is connected to the ground portion of the power circuit board through the conductive member of the main body.

As shown in FIG. 10, the cover open switch 51 is situated at a normal position, and the opening/closing lever 52 is situated at a close position for closing the discharge stacker 30. In this state, the hooks 72 engage the holes 74. Accordingly, it is possible to securely prevent the discharge stacker 30 from opening.

As shown in FIG. 11, when the cover open switch 51 is pushed in an arrow direction C to rotate in an arrow direction D, the pressing portion 76 pushes the opening/closing lever 52 in the arrow direction B. Accordingly, the opening/closing lever 52 moves to an open position for opening the discharge stacker 30, and the hooks 72 are disengaged from the holes 74, thereby opening the discharge stacker 30.

When the maintenance operation is performed, the operator needs to open the discharge stacker 30. When the operator pushes the cover open switch 51, the operator contacts with the cover open switch 51. Accordingly, it is possible to release static electricity accumulated in the operator to the ground portion through the cover open switch 51, the spring 54, and the conductive member of the main body.

As described above, in the embodiment, the cover open switch 51 is provided as the operation member, and the cover open switch 51 is connected to the ground portion. Alternatively, instead of the cover open switch 51, a power switch of the printer 11 or a handle (FIG. 1) of the medium cassette 12 as the medium storage unit may be used and connected to the ground portion. In this case, when the operator turns on the printer 11, or places the sheet (not shown) on the medium cassette 12, the operator touches the switch or the handle, thereby releasing static electricity accumulated in the operator.

In the embodiments described above, the printer is explained as the image forming apparatus. The present invention is applicable to a copier, a facsimile, a multi-function product, and the likes.

Further, the present invention is applicable to an electronic apparatus such as a portable CD (Compact Disk) player, a note-type personal computer, and the likes. In this case, when an operator opens a cover of a portable CD (Compact Disk) player or a note-type personal computer, the operator touches a specific portion, thereby releasing static electricity accumulated in the operation.

The disclosure of Japanese Patent Application No. 2007-066967, filed on Mar. 15, 2007 is incorporated in the application by reference.

While the invention has been explained with reference to the specific embodiments of the invention, the explanation is illustrative and the invention is limited only by the appended claims.

What is claimed is:

1. An image forming apparatus, comprising:

a main body having a ground portion;

a maintenance member disposed on the main body and having a portion to be maintained by a maintenance man who performs maintenance of the image forming apparatus;

a handle member formed as a part of the maintenance member and disposed at a location other than the portion so that the maintenance man grabs the handle member with a hand when the maintenance man performs the maintenance; and a hand touch member formed of a first conductive member and disposed on the handle member, said first conductive member being connected to the ground portion through a second conductive member, wherein said ground portion is disposed on a power source unit disposed on the main body, and said maintenance member includes a developer storage unit.

2. The image forming apparatus according to claim 1, wherein said first conductive member is formed of an aluminum foil.

3. The image forming apparatus according to claim 1, wherein said hand touch member is adapted to connect to the ground portion.

4. The image forming apparatus according to claim 1, wherein said hand touch member is connected to the ground portion through a cable, said cable including a protective member.

5. The image forming apparatus according to claim 1, wherein said maintenance member includes an image forming unit.

6. The image forming apparatus according to claim 1, wherein said maintenance member includes an exposure unit.

7. An image forming apparatus, comprising:

a main body having a ground portion;

a maintenance member disposed on the main body and having a portion to be maintained by a maintenance man who performs maintenance of the image forming apparatus;

a handle member formed as a part of the maintenance member and disposed at a location other than the portion so that the maintenance man grabs the handle member with a hand when the maintenance man performs the maintenance; and a hand touch member formed of a first conductive member and disposed on the handle member, said first conductive member being connected to the ground portion through a second conductive member, wherein said ground portion is disposed on a power source unit disposed on the main body, and said maintenance member is formed of an LED (Light Emitting Diode) and a lens array as the portion to be maintained, and said handle member is formed of a supporting holder for supporting the LED head.

8. The image forming apparatus according to claim 7, wherein said first conductive member is formed of an aluminum foil.

9. The image forming apparatus according to claim 7, wherein said hand touch member is adapted to connect to the ground portion.

10. The image forming apparatus according to claim 7, wherein said hand touch member is connected to the ground portion through a cable, said cable including a protective member.

11. The image forming apparatus according to claim 7, wherein said maintenance member includes an image forming unit.

12. The image forming apparatus according to claim 7, wherein said maintenance member includes a developer storage unit.

13. The image forming apparatus according to claim 7, wherein said maintenance member includes an exposure unit.

* * * * *